US007682180B2

(12) United States Patent
Brown et al.

(10) Patent No.: US 7,682,180 B2
(45) Date of Patent: Mar. 23, 2010

(54) ELECTRICAL CONNECTOR WITH INTEGRAL TERMINAL RETENTION AND TERMINAL POSITION ASSURANCE

(75) Inventors: Michael Dale Brown, Colfax, NC (US); Andrew Jacob Vasbinder, Etters, PA (US); Matthew Bryan Hitchcock, Harrisburg, PA (US); Patrick L. Horner, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/111,689

(22) Filed: Apr. 29, 2008

(65) Prior Publication Data

US 2009/0269963 A1 Oct. 29, 2009

(51) Int. Cl.
*H01R 13/627* (2006.01)

(52) U.S. Cl. ..... 439/352

(58) Field of Classification Search ..... 439/352–358, 439/752, 595

See application file for complete search history.

(56) References Cited

U.S. PATENT DOCUMENTS 5,730,627 A * 3/1998 Okabe ..... 439/752
6,604,966 B1 * 8/2003 Hayes et al. ..... 439/752

FOREIGN PATENT DOCUMENTS

EP 1 176 670 1/2002

OTHER PUBLICATIONS

Socket Housing, IO Position 2×5, MQS Connector, Tyco Part No. 1488973, MQS plugs from Germany designed for MQS contact (1 pg.).
Interface, 2×5, MQS, Tyco Part No. 1488973, MQS plugs from Germany designed for MQS contact (1 pg.).
International Search Report, International Application No. PCT/US2009/002371, International Filing Date Apr. 16, 2009.

* cited by examiner

*Primary Examiner*—Renee Luebke
*Assistant Examiner*—Larisa Tsukerman

(57) ABSTRACT

An electrical connector includes a dielectric housing having at least one contact cavity extending along a longitudinal axis between a mating end and an opposite contact loading end. A primary terminal lock extends from an interior wall of the housing and is configured to engage a terminal contact to retain the terminal contact in the at least one contact cavity. A secondary locking member is integrally formed with the housing. The secondary locking member has a flexible hinge member proximate the contact loading end that pivotably connects the secondary locking member to the housing. The secondary locking member includes an engagement end that is received in the housing in a direction transverse to the axis of the at least one contact cavity to provide a visible indication of a seating condition of the terminal contact.

20 Claims, 6 Drawing Sheets

ELECTRICAL CONNECTOR WITH INTEGRAL TERMINAL RETENTION AND TERMINAL POSITION ASSURANCE

BACKGROUND OF THE INVENTION

The invention relates generally to electrical connectors and more particularly to a connector with integral terminal position assurance and terminal retention features.

A variety of electrical connector systems are in use that include a dielectric housing having a plurality of terminal-receiving cavities within which are mounted a plurality of terminal contacts. Improper installation or loading of terminal contacts inside the connector housing may create significant problems for an installer or an end user when undiagnosed at the time of assembly. Terminal position assurance (TPA) elements or secondary locks are commonly used in connectors to secure inserted terminal contacts in their respective connector cavities in proper position for electrically mating with the terminal contacts of a mating connector. Such connector systems are widely used in the automotive industry where various automotive systems require more secure retention of the terminal contacts within the connector so that the terminal contacts are less likely to vibrate out or be inadvertently removed, such as during the servicing of a nearby component or system.

Known connector systems with secondary locks are not without disadvantages. For instance, such systems require that multiple parts be provided at assembly stations, there is the risk of lost or misplaced parts, and added costs are associated with the production of separate parts, etc. Typically, the housing and the TPA or secondary lock are molded in separate molds and then pre-assembled to a pre-staged condition, requiring an assembly process and equipment. In addition, special packaging may also be required to assure that the pre-staged condition of the assembly is not violated during shipping to a harness maker or other customer.

A need remains for a low cost reliable connector system including secondary locking and terminal retention features that the may be manufactured with reduced molding, assembly, and packaging costs.

BRIEF DESCRIPTION OF THE INVENTION

In one embodiment, an electrical connector is provided. The connector includes a dielectric housing having at least one contact cavity extending along a longitudinal axis between a mating end and an opposite contact loading end. A primary terminal lock extends from an interior wall of the housing and is configured to engage a terminal contact to retain the terminal contact in the at least one contact cavity. A secondary locking member is integrally formed with the housing. The secondary locking member has a flexible hinge member proximate the contact loading end that pivotably connects the secondary locking member to the housing. The secondary locking member includes an engagement end that is received in the housing in a direction transverse to the axis of the at least one contact cavity to provide a visible indication of a seating condition of the terminal contact.

Optionally, the secondary locking member is pivotable between an open position wherein terminal contacts may be loaded into the housing and a closed position wherein the terminal contacts are locked in the housing. The housing includes an opening in an exterior wall that is transverse to and in communication with the at least one contact cavity. The secondary locking member includes a latch element that engages a ledge in the housing to lock the secondary locking member in a closed position. The secondary locking member spans multiple adjacent contact cavities. The secondary locking member includes an engagement end that is configured to abut a partially seated terminal contact to prevent the secondary locking member from moving to a closed position.

In another embodiment, an electrical connector is provided that includes a dielectric housing having at least one contact cavity extending along a longitudinal axis between a mating end and an opposite contact loading end. A primary terminal lock extends from an interior wall of the housing and is configured to engage a terminal contact to retain the terminal contact in the at least one contact cavity. A secondary locking member is integrally formed with the housing and has a flexible hinge member proximate the contact loading end that pivotably connects the secondary locking member to the housing. The secondary locking member includes an engagement end that is configured to be received in a recess in the terminal contact when the terminal contact is fully seated in the at least one contact cavity.

In yet another embodiment, an electrical connector is provided that includes a dielectric housing having at least one contact cavity extending along a longitudinal axis between a mating end and an opposite contact loading end. A primary terminal lock extends from an interior wall of the housing and is configured to engage a terminal contact to retain the terminal contact in the at least one contact cavity. A secondary locking member is integrally formed with the housing and has a flexible hinge member proximate the contact loading end that pivotably connects the secondary locking member to the housing. The secondary locking member includes a clearance channel that is configured to receive an end of a mating contact when the mating contact is fully mated with the terminal contact.

DETAILED DESCRIPTION OF THE INVENTION

Figure 1:
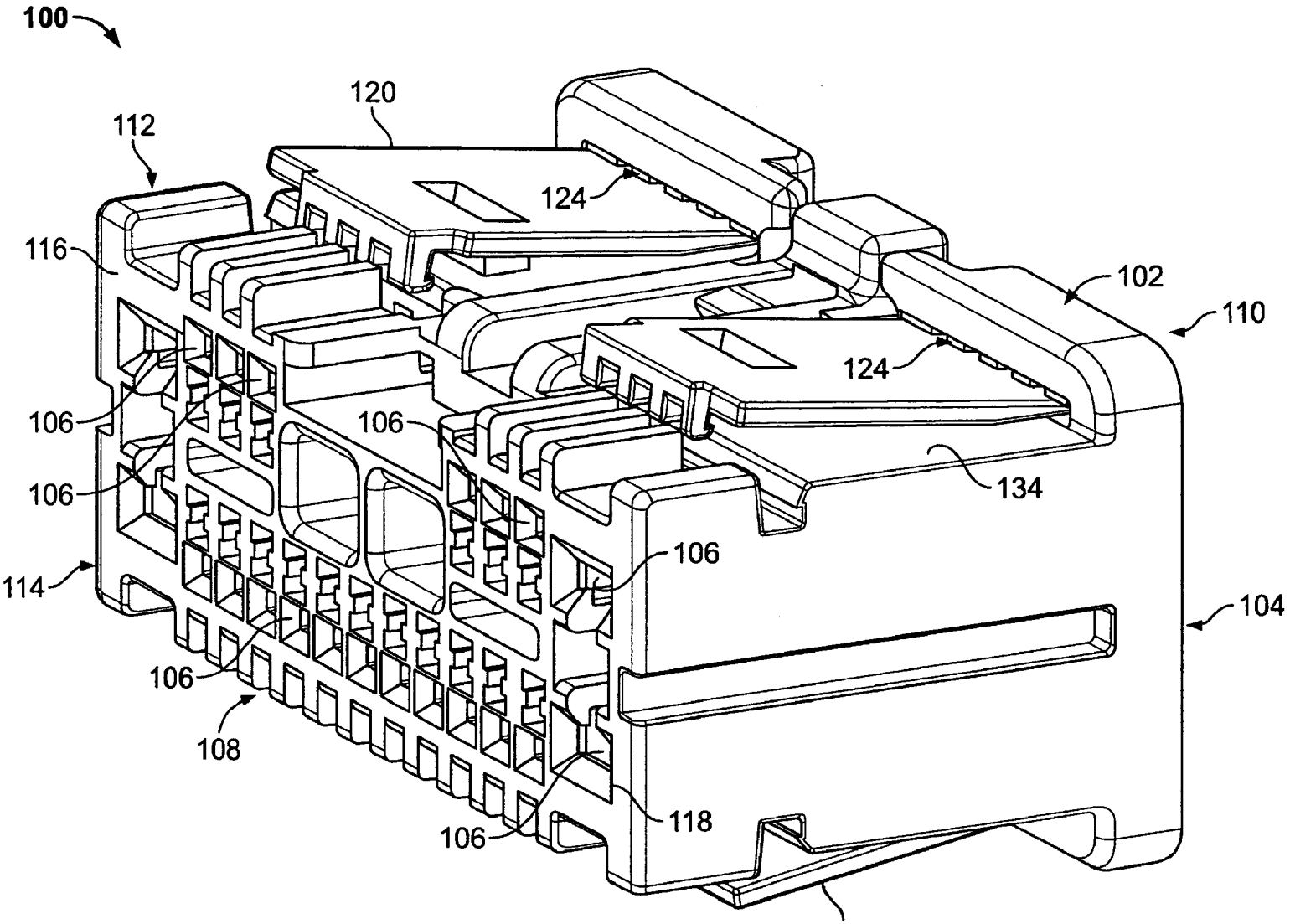
FIG. 1 is a perspective view if an electrical connector formed in accordance with an exemplary embodiment of the present invention.
Figure 2:
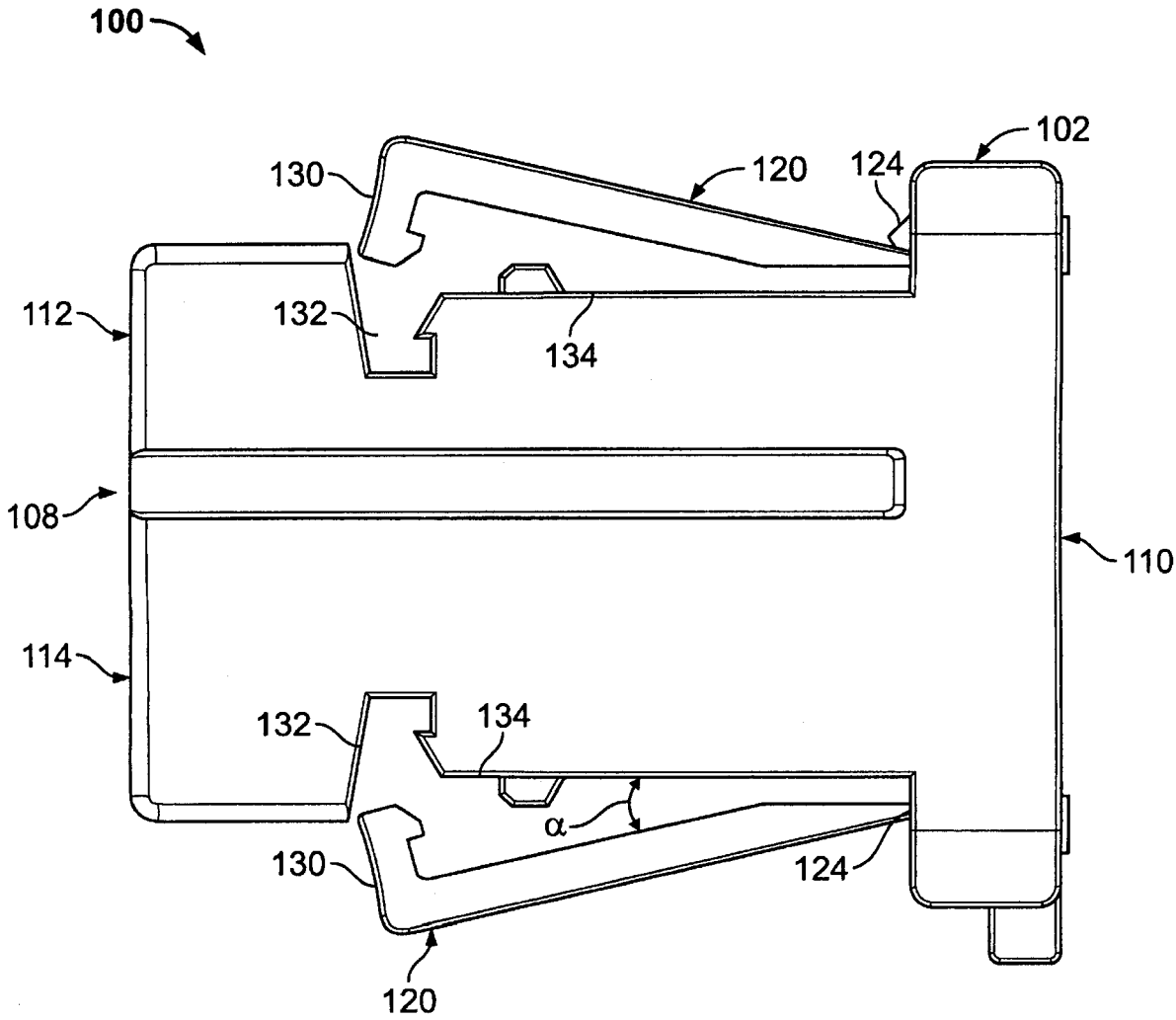
FIG. 2 is a side elevational view of the connector shown in FIG. 1.

FIG. 1 illustrates a perspective view if an electrical connector 100 formed in accordance with an exemplary embodiment of the present invention. FIG. 2 illustrates a side elevational view of the connector 100. The connector includes a dielectric housing 102 that has a main housing body 104 having a plurality of contact terminal cavities 106. Each contact cavity 106 is sized and designed to accommodate a terminal contact (not shown in FIG. 1). The housing 102 includes a mating end 108 and a contact loading end 110. As illustrated, the housing 102 includes an upper section 112 and a lower section 114. The contact cavities 106 in the upper section 112 are arranged in a row 116. Similarly, the contact cavities 106 in the lower section 114 are arranged in a row 118. The contact cavity rows 116 and 118 need not be identical to one another. That is, the contact cavities 106 in the contact cavity rows 116 and 118 may differ in size and/or number. Further, the benefits of the invention may be realized in a connector that includes only one row of contact cavities.

The housing 102 is formed with a secondary locking member, or terminal position assurance member 120, formed in accordance with an exemplary embodiment of the present invention. The secondary locking member 120 is provided to detect the partial insertion of terminal contacts and to provide secondary locking of terminal contacts 166 (see FIG. 4) as will be described. The secondary locking member 120 is molded as an integral part of the housing 102. A flexible hinge member 124 which may comprise a living hinge member joins the secondary locking member 120 to the main housing body 104. By molding the secondary locking member 120 as an integral part of the housing 102, the need for a separate mold and separate molding operation are eliminated, which reduces manufacturing costs. In addition, pre-assembly of the housing and the secondary locking member is not required and no special packaging is required. The secondary locking member 120 is molded at an angle $\alpha$ with respect to the main housing body 104. In one embodiment, the angle $\alpha$ is about fifteen degrees. The secondary locking member 120 can be cycled multiple times as needed to meet service requirements. The secondary locking member 120 includes a secondary locking element 130 that is received in an opening 132 in an exterior wall 134 of the housing body 104. The opening 132 extends into the contact cavities 106 as will be described.

Figure 3:
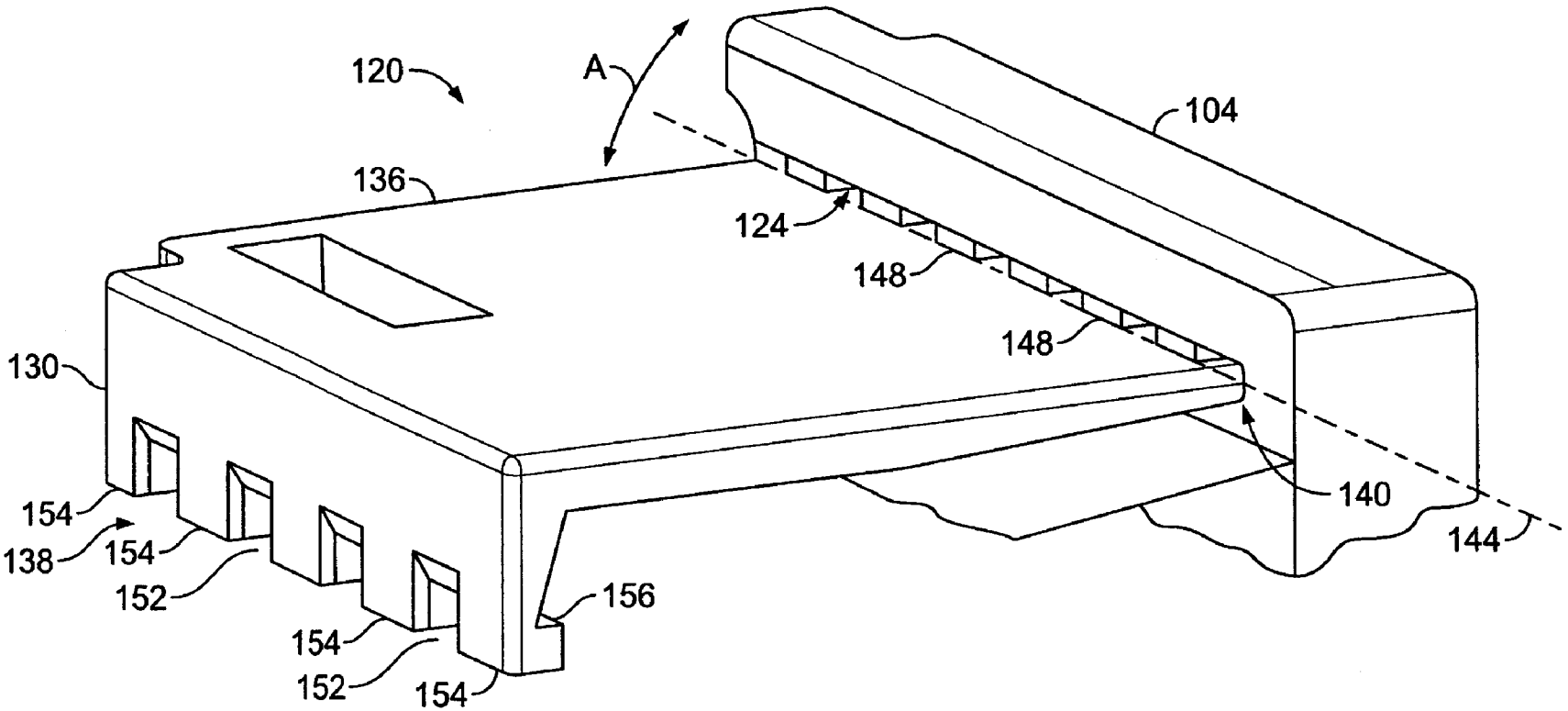
FIG. 3 is a perspective view of a secondary locking member formed in accordance with an exemplary embodiment of the present invention.

FIG. 3 illustrates a perspective view of the secondary locking member 120. The secondary locking member includes a planar body 136 that has a forward end 138 opposite a rearward pivot end 140. The hinge member 124 defines a pivot axis 144. In one embodiment, the hinge member 124 may comprise a plurality of hinge elements 148. Alternatively, in other embodiments, the hinge member 124 may comprise a single continuous member. The secondary locking member 120 is pivotable in the direction of the arrow A about the pivot axis 144 between an open position wherein the secondary locking member 120 is positioned to permit the loading of terminal contacts 166 (see FIG. 4) into the housing 102 (FIG. 1) and a closed position wherein the secondary locking member 120 is positioned to lock the terminal contacts 166 in the housing 102. When a partially seated terminal contact is present, the secondary locking member 120 is prevented from moving completely to the closed position and thereby the secondary locking member 120 gives a visual indication that one or more terminal contacts 166 is only partially seated in the contact cavities 106 (FIG. 1).

The secondary locking element 130 is formed proximate the forward end 138 of the body 136. In one embodiment, the opening 132 may span multiple adjacent contact cavities 106. The secondary locking element 130 is configured to be received in the opening 132 in the housing body 104 and extend into and across one or more contact cavities 106 (FIG. 1). If any of the contact cavities 106 includes a partially inserted terminal contact 166 (see FIG. 4), the secondary locking member 120 is prevented from moving to the closed position. It is to be understood that the housing 102 is loaded with terminal contacts 166 according to the requirements of particular applications. As such, one or more contact cavities 106 may not contain a terminal contact 166. Such unused contact cavities 106 are treated as a properly loaded contact cavity and not as having a terminal seating error. The secondary locking element 130 includes a plurality of clearance channels 152 formed between terminal engagement ends 154. A latch element 156 is formed on a rearward side of each terminal engagement end 154. Each clearance channel 152 is aligned with a contact cavity 106 that is spanned by the secondary locking element 130.

Figure 4:
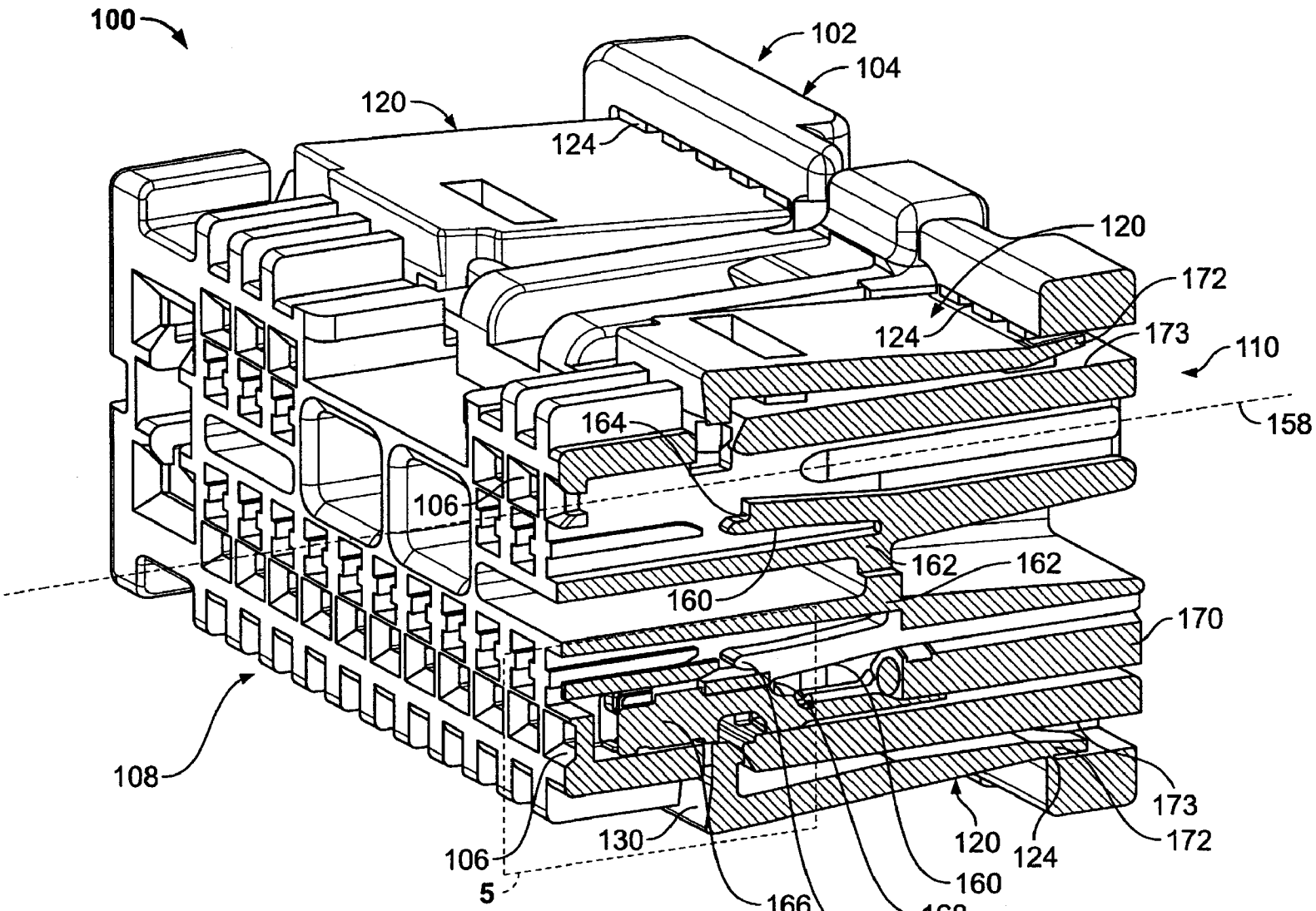
FIG. 4 is a perspective view of a connector housing partially cut away to reveal a contact cavity.

FIG. 4 illustrates a perspective view of the connector housing 102 partially cut away to reveal the interior of a representative contact cavity 106. Each contact cavity 106 extends along a longitudinal axis 158 between the housing mating end 108 and the contact loading end 110. A primary terminal lock 160 extends from an interior wall 162 of the housing 102 proximate the location of each contact cavity 106. The primary terminal locks 160 are integrally formed with the housing 102. Each primary terminal lock 160 includes an engagement end 164 that partially extends into a contact cavity 106.

In FIG. 4, a terminal contact 166 is shown in one contact cavity 106. The terminal contact 166 is attached to a wire or cable 170 according to known methods. The terminal contact 166 is inserted into the contact cavity 106 from the contact loading end 110 of the housing 102 and is urged toward the connector mating end 108 until the terminal contact 166 is fully seated. During loading of the terminal contact 166 into the contact cavity 106, the terminal contact 166 pushes the primary terminal lock 160 to deflect out of the way to allow the terminal contact 166 to pass into the contact cavity 106. When the terminal contact 166 is fully inserted into the contact cavity 106, the primary terminal lock 160 springs back toward its original position to engage a rearward edge 168 of the terminal contact 166. The primary terminal lock 160 thereby prevents withdrawal of the terminal contact 166 from the contact cavity 106 thus retaining the terminal contact 166 in the contact cavity 106. The primary terminal lock 160 retains the terminal contact 166 in the contact cavity 106 until population of housing 102 with terminal contacts 166 is completed and the secondary locking member 120 is moved to the closed position to lock the terminal contacts 166 in the housing 102.

The secondary locking member 120 includes an extension 172 that extends rearward beyond the hinge member 124 and toward the contact loading end 110. The extension 172 is configured to engage a surface 173 on the housing 102 to provide overstress protection for the hinge member 124 when the secondary locking member 120 is opened. That is, the extension 172 limits the opening of the secondary locking member 120 so as to prevent cracking or breaking of the hinge member 124.

Figure 5:
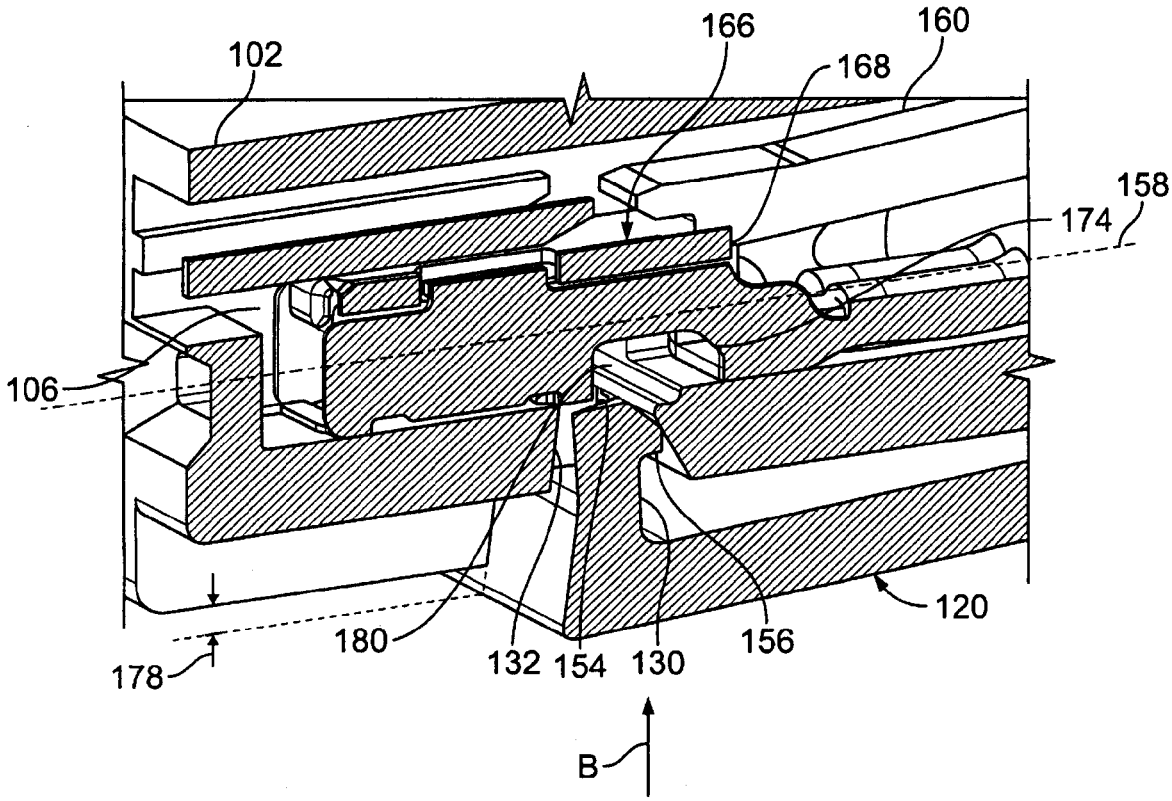
FIG. 5 is an enlarged view of a portion of the housing shown in FIG. 4 with a partially seated terminal contact.
Figure 6:
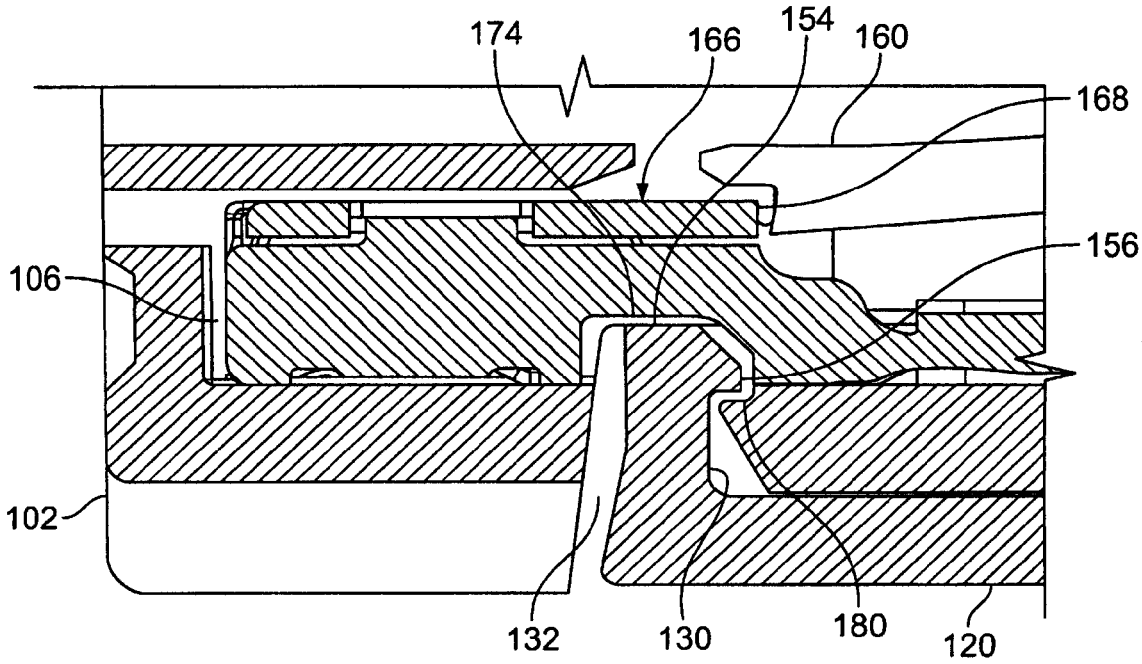
FIG. 6 is an enlarged view of a portion of the housing shown in FIG. 4 with a fully seated terminal contact.

FIG. 5 illustrates an enlarged view of a portion of the housing 102 with the terminal contact 166 in a partially seated condition. FIG. 6 illustrates an enlarged view of a portion of the housing 102 with the terminal contact 166 in a fully seated condition. The secondary locking element 130 is received in the opening 132 in the direction of the arrow B which is transverse to axis 158 of the contact cavity 106. The terminal contact 166 includes a recess 174 that aligns with the opening 132 in the housing 102 when the terminal contact 166 is fully seated in the contact cavity 106. When the terminal contact 166 is partially seated, the secondary locking element 130 stubs or abuts against the terminal contact 166 in a manner that prevents the secondary locking member 120 from moving to the closed position. More specifically, when the terminal contact 166 is partially seated, attempts to close the secondary locking member 120 leaves a step 178 between the secondary locking member 120 and the housing 102 that provides a visual indication that the terminal contact 166 is only partially seated.

When the terminal contact 166 is fully seated in the contact cavity 106, a portion of a respective terminal engagement end 154 on the secondary locking element 130 is received in the recess 174 when the secondary locking member 120 is moved to the closed position. Further, when closed, the secondary locking member 120 fits flush with the housing 102 giving a visual indication that none of the terminal contacts 166 is only partially inserted in the contact cavities 106. When all of the terminal contacts 166 are fully inserted in the contact cavities 106 and the secondary locking member 120 is moved to the closed position, the latch element 156 snaps over and engages a ledge 180 in the housing 102 to lock the secondary locking member 120 in the closed position. Simultaneously, the secondary locking member 120 locks the terminal contacts 166 in the contact cavities 106.

Figure 7:
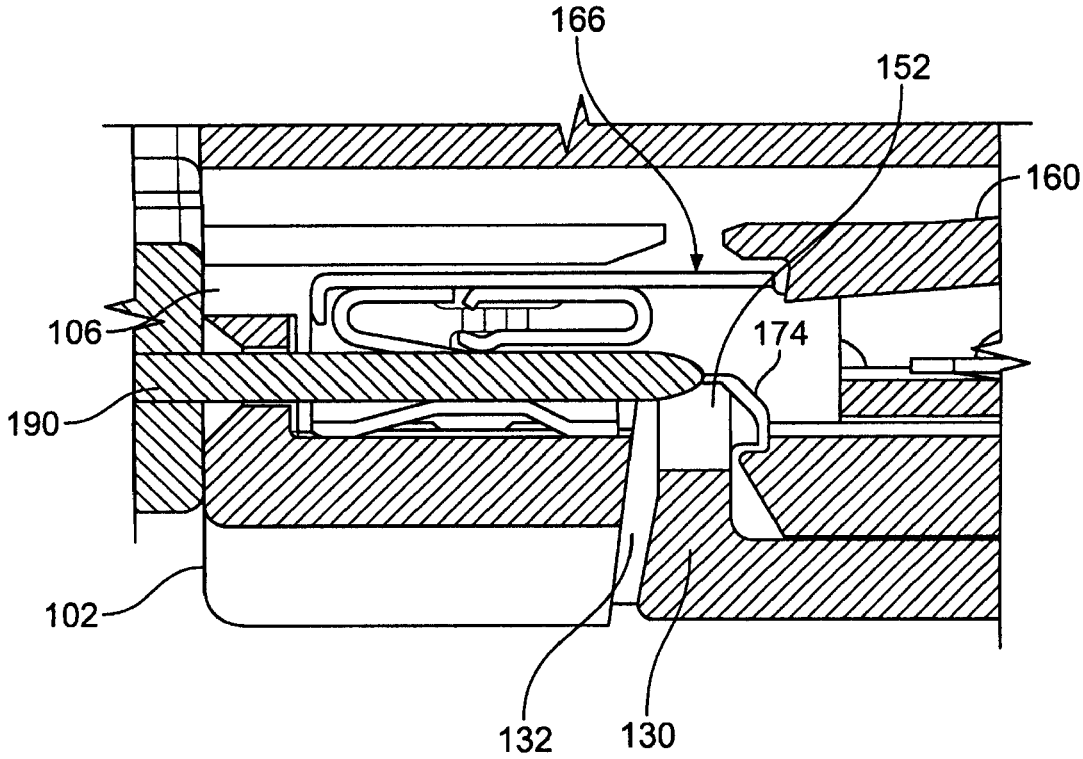
FIG. 7 is an enlarged view of a portion of the housing shown in FIG. 4 with a mated terminal contact.
Figure 8:
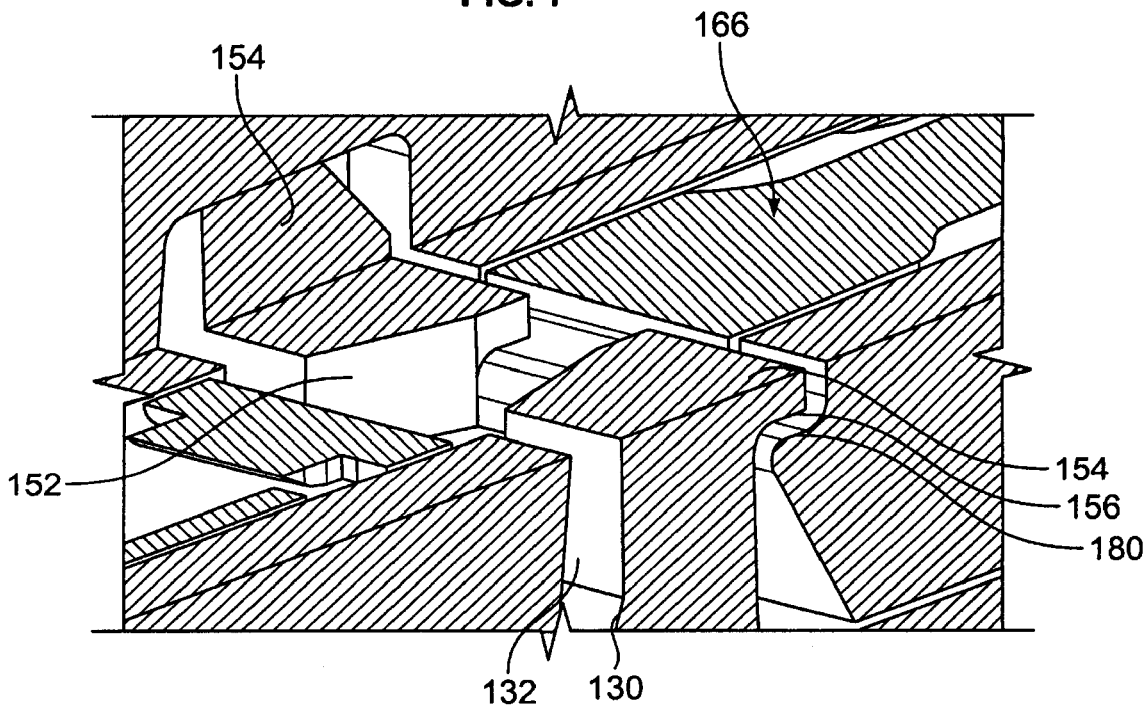
FIG. 8 is an enlarged partial cross sectional view of a secondary locking element extending into a contact cavity.

FIG. 7 illustrates an enlarged view of a portion of the housing 102 with a mated terminal contact 166. FIG. 8 is an enlarged partial cross sectional view of a secondary locking element 130 extending into a contact cavity 106. When the secondary locking member 120 is in the locked position, a portion of the terminal engagement end 154 of the secondary locking element 130 extends into the recess 174 in the terminal contact 166. The extension of the terminal engagement end 154 of the secondary locking element 130 into the terminal contact 166 represents a potential obstruction to a mating pin contact 190 of a mating connector (not shown). When the terminal contact 166 is mated, the mating pin 190 is received into the terminal contact 166. The clearance channels 152 in the secondary locking element 130 are provided to prevent stubbing of the mating pin 190 against the terminal engagement ends 154 of the secondary locking element 130. That is, the clearance channel 152 allows the mating pin 190 to fully mate with the terminal contact 166.

The embodiments thus described provide a connector with an integrally formed secondary terminal locking member that locks terminal contacts in the contact cavities in the housing and provides terminal position assurance. The connector, including the secondary lock is formed in a single molding operation which reduces manufacturing costs. The connector does not require pre-staging of separate components and does not require special packaging for shipment.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical connector comprising:

a dielectric housing having at least one contact cavity extending along a longitudinal axis between a mating end and an opposite contact loading end;

a primary terminal lock extending from an interior wall of said housing and configured to engage a terminal contact to retain the terminal contact in said at least one contact cavity, and a secondary locking member integrally formed with said housing and having a flexible hinge member proximate said contact loading end that pivotably connects said secondary locking member to said housing, said secondary locking member being pivoted about said flexible hinge member between an unseated position and a seated position, the secondary locking member being configured to retain the terminal contact in said at least one contact cavity when said secondary locking member is in the seated position, said secondary locking member including an engagement end that is received in said housing in a direction transverse to the axis of said at least one contact cavity to provide a visible indication of a seating condition of the terminal contact.

2. The electrical connector of claim 1, wherein said housing includes an opening in an exterior wall, said opening being transverse to and in communication with said at least one contact cavity.

3. The electrical connector of claim 1, wherein said secondary locking member includes an extension configured to engage a surface on said housing to provide overstress protection for said flexible hinge member by limiting the opening of said secondary locking member.

4. The electrical connector of claim 1, wherein said secondary locking member includes a latch element that engages a ledge in said housing to lock said secondary locking member in a closed position.

5. The electrical connector of claim 1, wherein said secondary locking member spans multiple adjacent contact cavities.

6. The electrical connector of claim 1, wherein said secondary locking member includes an engagement end configured to abut a partially seated terminal contact to prevent said secondary locking member from moving to a closed position.

7. The electrical connector of claim 1, wherein said secondary locking member is pivotable between an open position wherein terminal contacts may be loaded into said housing and a closed position wherein the terminal contacts are locked in said housing.

8. An electrical connector comprising:

a dielectric housing having at least one contact cavity extending along a longitudinal axis between a mating end and an opposite contact loading end;

a primary terminal lock extending from an interior wall of said housing and configured to engage a terminal contact to retain the terminal contact in said at least one contact cavity, and a secondary locking member integrally formed with said housing and having a flexible hinge member proximate said contact loading end that pivotably connects said secondary locking member to said housing, said secondary locking member being pivoted about said flexible hinge member between an unseated position and a seated position, the secondary locking member being configured to retain the terminal contact in said at least one contact cavity when said secondary locking member is in the seated position, said secondary locking member including an engagement end that is configured to be received in a recess in the terminal contact when the terminal contact is fully seated in said at least one contact cavity.

9. The electrical connector of claim 8, wherein said engagement end is configured to abut a partially seated terminal contact and provide a visual indication that the terminal contact is partially seated.

10. The electrical connector of claim 8, wherein said housing includes an opening in an exterior wall, said opening being transverse to and in communication with said at least one contact cavity.

11. The electrical connector of claim 8, wherein said secondary locking member includes an extension configured to engage a surface on said housing to provide overstress protection for said flexible hinge member by limiting the opening of said secondary locking member.

12. The electrical connector of claim 8, wherein said secondary locking member includes a latch element that engages a ledge in said housing to lock said secondary locking member in a closed position.

13. The electrical connector of claim 8, wherein said secondary locking member spans multiple adjacent contact cavities.

14. The electrical connector of claim 8, wherein said secondary locking member is pivotable between an open position wherein terminal contacts may be loaded into said housing and a closed position wherein the terminal contacts are locked in said housing.

15. An electrical connector comprising:

a dielectric housing having at least one contact cavity extending along a longitudinal axis between a mating end and an opposite contact loading end;

a primary terminal lock extending from an interior wall of said housing and configured to engage a terminal contact to retain the terminal contact in said at least one contact cavity, and a secondary locking member integrally formed with said housing and having a flexible hinge member proximate said contact loading end that pivotably connects said secondary locking member to said housing, said secondary locking member being pivoted about said flexible hinge member between an unseated position and a seated position, the secondary locking member being configured to retain the terminal contact in said at least one contact cavity when said secondary locking member is in the seated position, said secondary locking member including a clearance channel that is configured to receive an end of a mating contact when the mating contact is fully mated with the terminal contact.

16. The electrical connector of claim 15, wherein said secondary locking member includes an engagement end that is configured to abut a partially seated terminal contact and provide a visual indication that the terminal contact is partially seated.

17. The electrical connector of claim 15, wherein said secondary locking member includes an engagement end that is received in said housing in a direction transverse to the axis of said at least one contact cavity.

18. The electrical connector of claim 15, wherein said secondary locking member includes an extension configured to engage a surface on said housing to provide overstress protection for said flexible hinge member by limiting the opening of said secondary locking member.

19. The electrical connector of claim 15, wherein said secondary locking member includes a latch element that engages a ledge in said housing to lock said secondary locking member in a closed position.

20. The electrical connector of claim 15, wherein said secondary locking member is pivotable between an open position wherein terminal contacts may be loaded into said housing and a closed position wherein the terminal contacts are locked in said housing.

* * * * *